US006416048B2

(12) United States Patent
Tomiyama et al.

(10) Patent No.: US 6,416,048 B2
(45) **Date of Patent: *Jul. 9, 2002**

(54) METHOD AND APPARATUS FOR PICKING UP PAPERS

(75) Inventors: Katsuya Tomiyama, Tokyo; Kenichi Ikegami, Kanagawa, both of (JP)

(73) Assignee: NEC Corporation, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/283,211

(22) Filed: Apr. 1, 1999

(30) Foreign Application Priority Data

Oct. 5, 1998 (JP) ..... 10-282815

(51) Int. Cl.[7] ..... B65H 3/12
(52) U.S. Cl. ..... 271/95; 271/98; 271/107
(58) Field of Search ..... 271/94, 95, 98, 271/104, 107, 31.1; 414/797

(56) References Cited

U.S. PATENT DOCUMENTS

| | | | | | |
|---|---|---|---|---|---|
| 3,079,147 A | * | 2/1963 | Childs | ..... | 271/98 |
| 3,937,458 A | * | 2/1976 | Langen | ..... | 271/95 |
| 5,029,834 A | * | 7/1991 | Boldrini et al. | ..... | 271/95 |

FOREIGN PATENT DOCUMENTS

| | | | | | |
|---|---|---|---|---|---|
| AU | 151 129 | * | 1/1951 | ..... | 271/94 |
| DE | 1 203 801 | | 10/1965 | | |
| DE | 24 46 917 | * | 4/1975 | ..... | 271/98 |
| EP | 0 480 810 | | 4/1992 | | |
| FR | 2 219 665 | | 9/1974 | | |
| GB | 1 506 111 | | 4/1978 | | |
| JP | 52-13400 | | 2/1977 | | |
| JP | 59-223633 | | 12/1984 | | |
| JP | 2-231329 | | 9/1990 | | |
| JP | 403 216 430 A | * | 9/1991 | ..... | 271/104 |
| JP | 6-80260 | | 3/1994 | | |
| JP | 6-293448 | | 10/1994 | | |
| JP | 7-5192 | | 1/1995 | | |
| JP | 7-41199 | | 2/1995 | | |
| JP | 8 259016 | | 10/1996 | | |
| JP | 8-259016 | | 10/1996 | | |

* cited by examiner

*Primary Examiner*—H. Grant Skaggs
(74) *Attorney, Agent, or Firm*—Sughrue Mion, PLLC

(57) ABSTRACT

An apparatus for picking up a plurality of papers stacked in an upright position one by one is disclosed. A pick-up mechanism is angularly movable about a single point between a position for sucking the outermost paper and a position for conveying it. While an sending mechanism sends air toward the bottom of a stack of papers positioned on a tray, the pick-up mechanism sucks the outermost paper and moves away from the other papers at a low speed. After the pick-up mechanism has conveyed the above paper, it moves toward she next paper for sucking it at a high speed. Air being sent from the above mechanism insures the separation of the consecutive papers. Because the pickup mechanism retaining the outermost sheet by suction moves slowly away from the other papers, the outermost paper is easily spaced from the other papers and therefore more surely separated from the other papers. This obviates a shearing force otherwise acting on and damaging, e.g., letters and magazines of delicate quality.

48 Claims, 6 Drawing Sheets

METHOD AND APPARATUS FOR PICKING UP PAPERS

BACKGROUND OF THE INVENTION

The present invention relates to a method an apparatus for picking up papers and more particularly to a method and an apparatus for picking up papers stacked in an upright position one by one.

An apparatus for the above application is usually arranged at a stage preceding an automatic paper sorting machine. The apparatus picks up papers stacked in an upright position one by one while feeding them to the sorting machine, as taught in Japanese Patent Laid-Open Publication No. 8-259016 by way of example. The apparatus taught in this document includes a tray for temporarily stacking mails or similar papers, a belt for conveying the papers one by one while sucking them, and a separator roller for separating one paper to be conveyed from the other papers.

However, the problem with the above conventional apparatus is that a shearing force acts on the papers due to the sucking force of the belt and the frictional force of the separator roller. The shearing force is apt to damage, e.g., letters and magazines of delicate quality.

Technologies relating to the present invention are also disclosed in, e.g., Japanese Patent Laid-Open Publication Nos. 59-223633 and 2-231329 and Japanese Patent Publication No. 7-5192.

SUMMARY OF THE INVENTION

It is therefore an object of the present invention to provide a method and an apparatus capable of picking up papers one by one without any shearing force acting on the papers which may be letters or magazines of delicate quality.

In accordance with the present invention, a method of picking up a plurality of papers stacked in an upright position one by one includes the step of causing a pick-up mechanism to angularly move for sucking outermost one of the papers and picking it up.

Also, in accordance with the present invention, an apparatus for picking up a plurality of papers stacked in an upright position one by one includes a tray for stacking the papers, and a pick-up mechanism angularly movable for sucking outermost one of the papers and picking it

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENTS

Figure 1:
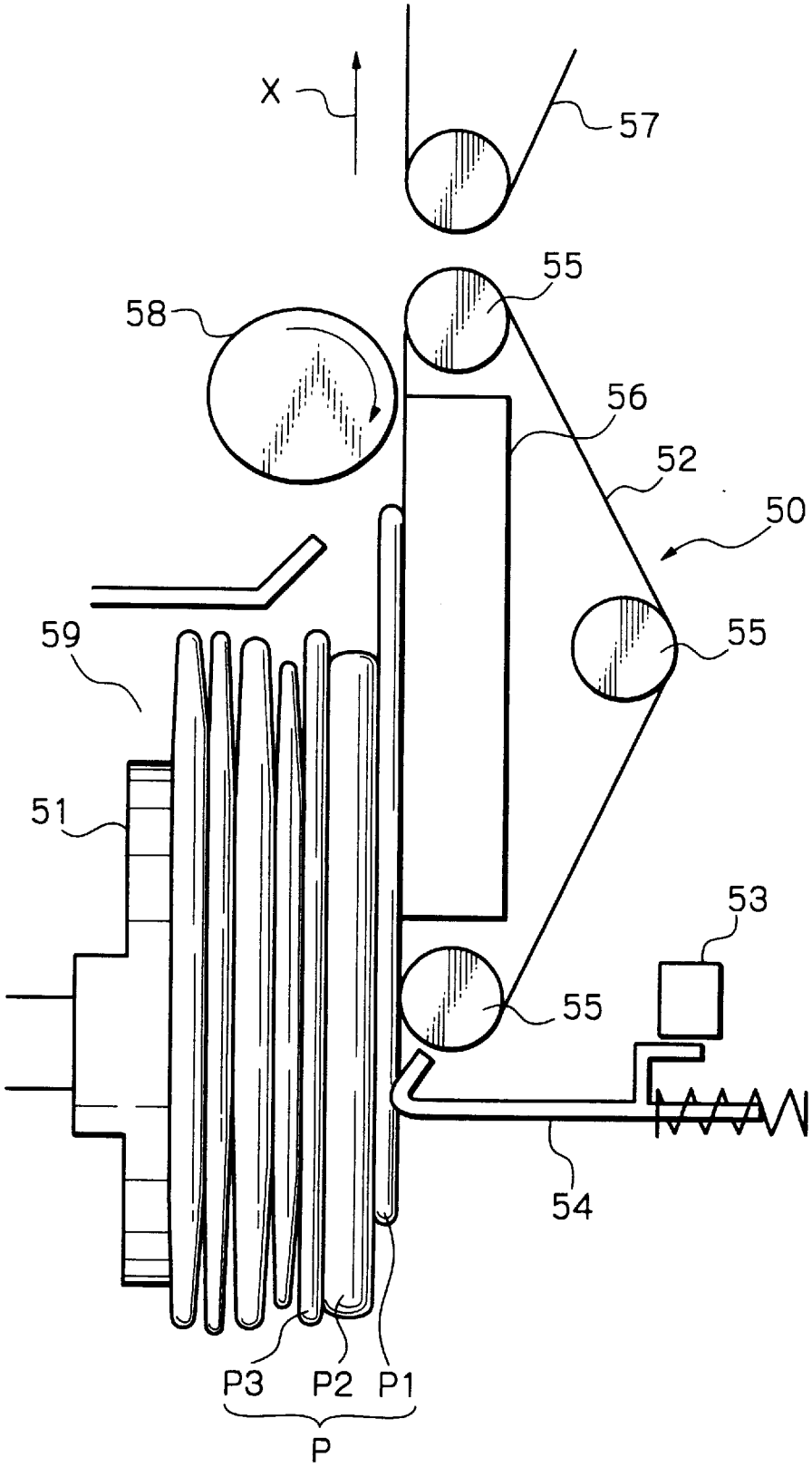
Fig. 1 PRIOR ART
FIG. 1 is a view showing a conventional apparatus for picking up papers.

To better understand the present invention, brief reference will be made to a conventional apparatus for picking up papers, shown in FIG. 1. The apparatus to be described is taught in Japanese Patent Laid-Open Publication No. 8-259016 mentioned earlier. As shown, the apparatus includes a tray 59 on which mails or similar papers P are temporarily stacked, a conveyor 51, and a pick-up mechanism 50. A drive source, not shown, causes the-conveyor 51 to start and stop operating on the tray 59. A sensor 53 determines whether or not the papers P are present on the tray 59 via a lever 54. A drive source, not shown, causes three rollers 55 to start and stop moving a belt 52. A plurality of holes are formed in the belt 52 at preselected intervals. A blower, not shown, evacuate a suction chamber 56 located at a preselected position opposite to the papers P with respect to the belt 52. A separator roller 58 is positioned downstream of the pick-up mechanism 50 in a direction X in which the mechanism 50 conveys the papers P. The separator roller 58 faces the belt 52 and is rotated in the opposite direction to the belt 52 by a drive source not shown.

In operation, the conveyor 51 conveys the papers P stacked on the tray 59 to a position where the outermost paper P1 contacts the belt 52, i.e., where the paper P1 turns on the sensor 53 via the lever 54, In response, the drive source assigned to the belt 52 drives the belt 52. When the holes of the belt 52 are brought into alignment with the suction chamber 56, the belt 52 sucks the paper P1 and conveys it to a path downstream of the pick-up mechanism 50 due to friction. After the paper P1 has been conveyed, the lever 54 is returned by. e.g., a spring while the sensor 53 is turned off. Subsequently, the conveyor 51 is operated until the next paper P2 turns on the sensor 53. This is followed by the procedure described above.

Assume that the paper P2 is entrained by the paper P1 due to friction acting therebetween or static electricity. Then, the separator roller 58 rotating in the opposite direction to the belt 52 exerts a load on the paper P2 and thereby separates the paper P2 from the paper P1. This allows the paper P1 to be surely picked up. However, the problem with this kind of scheme is that a shearing force acts on the papers P due to the sucking force of the belt 52 and the frictional force of the separator roller 58. The shearing force is apt to damage, e.g., letters and magazines of delicate quality, as discussed earlier.

Figure 2:
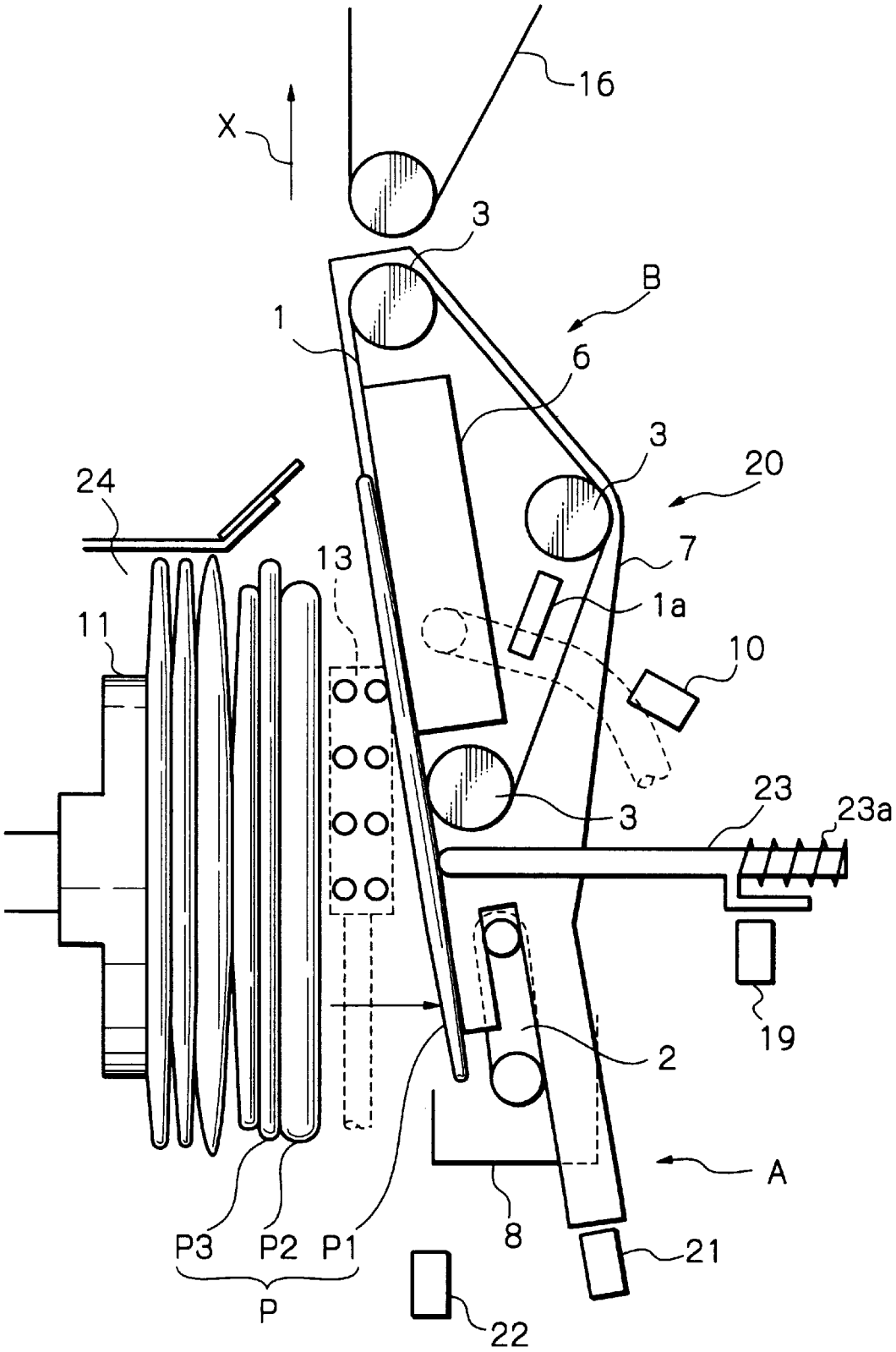
FIG. 2 is a view showing an apparatus for picking up papers embodying the present invention.

Referring to FIG. 2, an apparatus for picking up papers embodying the present invention is shown and includes a tray 24. A plurality of mails or similar papers P are stacked on the tray 24 in an upright position. A pick-up mechanism 20 is pivotable, or angularly movable, and picks up the papers P from the tray 24 one by one. An air sending mechanism 13 is communicated to, e.g., a compressor and located in the vicinity of a position where the pick-up mechanism 20 sucks the papers P. The air sending mechanism 13 sends air toward the bottom of the stack of papers P.

The pick-up mechanism 20 includes a pivoting portion A for causing the mechanism 20 to pivot and a conveying portion B for sucking and conveying the papers P one by one. The pivoting portion B is arranged on a base plate 7. The base plate 7 is connected to the conveying portion A at its upstream portion in a direction X in which the portion B conveys the papers P. The base plate 7 is pivotable about its downstream point in the direction, e.g., a point coincident with the axis of a downstream roller 3 included in the mechanism 20. The conveying portion B includes a belt 1 formed with a plurality of groups of holes at, e.g., equal intervals for conveying one paper while sucking it. A plurality of (three in the illustrative embodiment) rollers 3 move the belt 1 in the direction for conveying the paper, A vacuum chamber 6 faces the surface of the belt 1 opposite to the surface which the papers P face. A blower, for example, evacuates the suction chamber 6, although not shown specifically.

The pivoting portion A includes an arm 2 connected at one end to a servo motor 8 and at the other end to the base plate 7. The servo motor 8 causes the arm 2 to move back and forth about the end of the arm 2 connected to the motor 8, As a result, the pick-up mechanism 20 bodily pivots over a preselected angle about a single fixed point of the base plate 7 connected to the arm 2, e.g., about the downstream roller 3.

Specifically, the pick-up mechanism 20 is angularly movable between a position for sucking the papers P and a position for conveying them. Further, after the mechanism 20 has sucked one paper, it moves away from the other papers at a low speed. After the mechanism 20 has conveyed the paper, it moves toward the other papers at a high speed for sucking the next paper.

As shown in FIG. 2, a conveyor 11 conveys a plurality of papers P toward the pick-up mechanism 20. A lever 23 is constantly biased by a spring 23*a* toward the papers P. When the lever 23 is pressed by the papers P brought substantially to a position where the mechanism 20 sucks the papers P, it turns on a sensor 19. A sensor 22 is responsive to the mechanism 20 brought substantially to the above position where it sucks the papers P. A sensor 21 senses the mechanism 20 when the mechanism 20 having sucked one paper is moved away form the other papers to a position for conveying the one paper. A hole sensor 10 senses holes formed in the belt 1, as will be described specifically later. A conveyor 16 conveys the paper picked up by the mechanism 20 to an apparatus following the pick-up apparatus.

Figure 3:
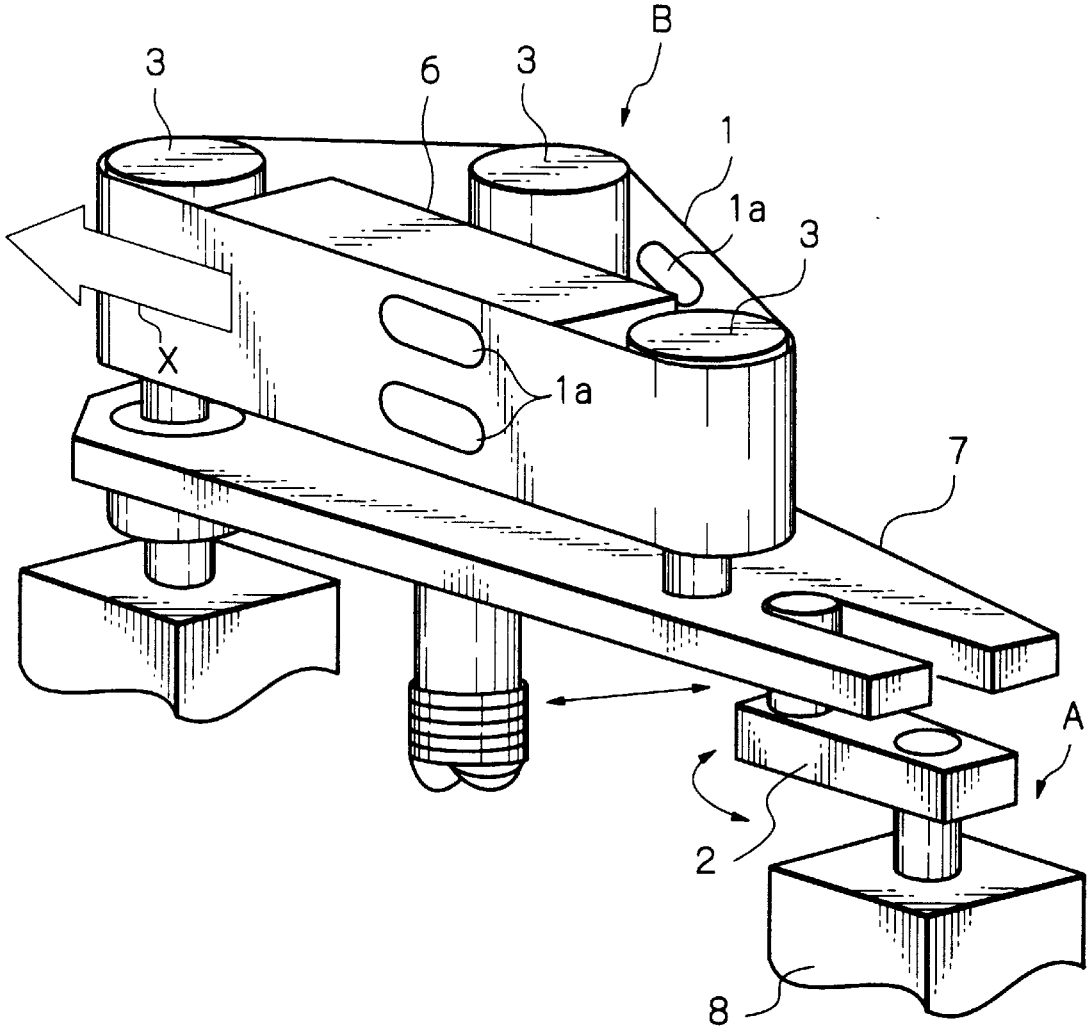
FIG. 3 is a view showing a specific configuration of a pick-up mechanism included in the illustrative embodiment.
Figure 4:
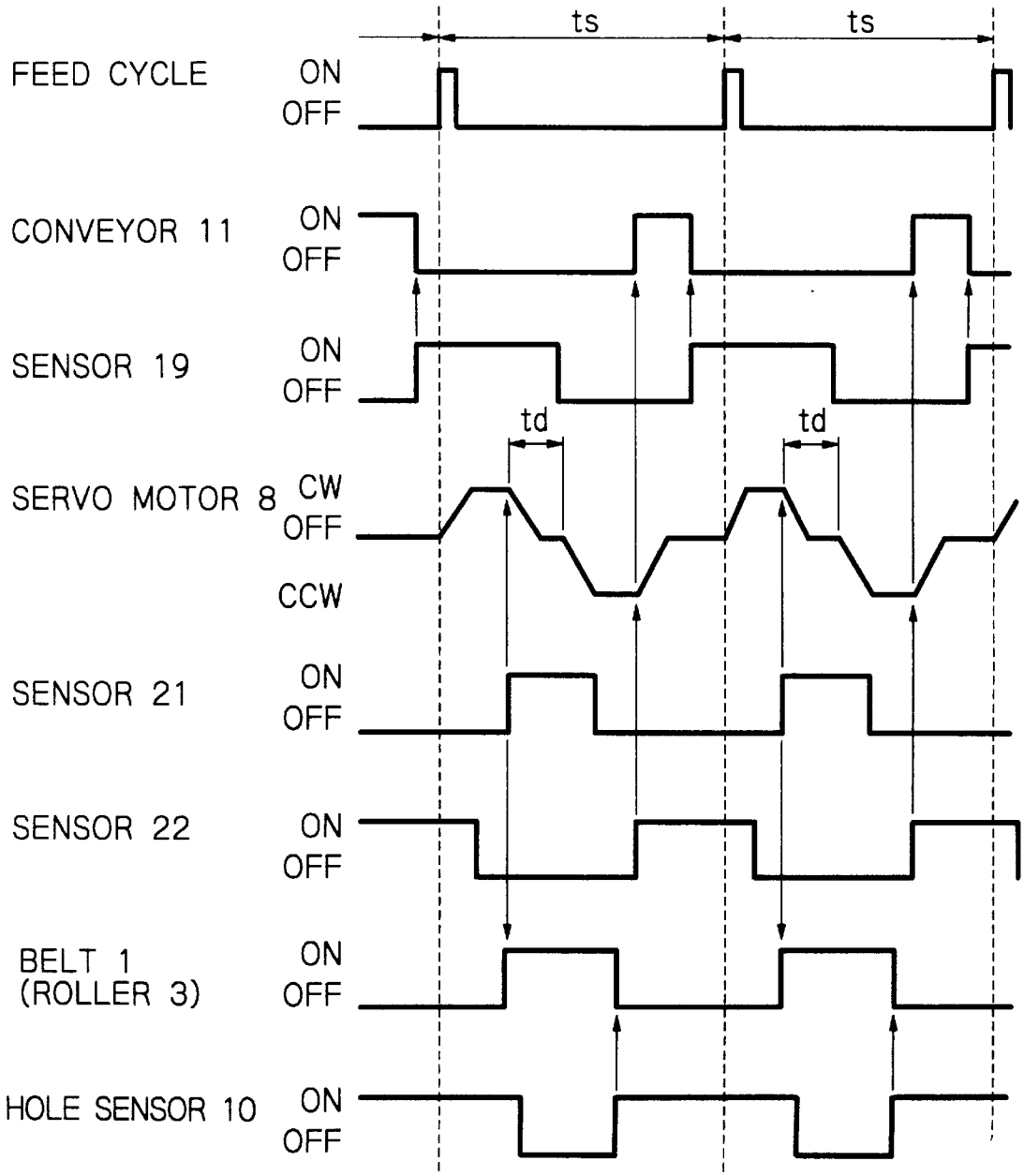
FIG. 4 is a timing chart demonstrating a specific operation of the illustrative embodiment.

The operation of the illustrative embodiment will be described with reference to FIGS. 2–4. As shown in FIG. 2, the pick-up mechanism 20 is initially located at the position for sucking the papers. The conveyor 11 conveys a plurality of papers P stacked on the tray 24 toward the mechanism 20The papers P press the lever 23 with the result that the sensor 19 turns on and causes the conveyor 11 to stop moving.

Assume that papers P1, P2, P3 and so forth are stacked on the tray 24 in this order, as named from the mechanism 20 side. Then. the belt 1 sucks the outermost paper P1 via its holes 1*a* due to vacuum generated in the vacuum chamber 6. The servo motor 8 starts rotating at a timing having a preselected period ts in synchronism with the apparatus following the pick-up apparatus and the conveyor 16 located downstream of the mechanism 20. The servo motor 8 moves the mechanism 21 toward the position to which the sensor 21 is responsive. While the angle of this movement of the mechanism 21 is determined by, e.g., experiments, it should preferably be, but not limited to, 2° to 5°.

The mechanism 20 sucked the paper P1 as stated above moves it away from the next paper P2. At this instant, the servo motor 8 is controlled such that the mechanism 20 moves at a speed low enough to prevent vacuum from being generated between the papers P1 and P2. This speed is also determined by experiments. The air sending mechanism 13 constantly sends air to the resulting gap between the papers P1 and P2 in order to further promote the separation of the paper P1 from the paper P2.

When the sensor 21 senses the mechanism 20 and turns on, a drive source, not shown, causes the rollers 3 to move the belt 1. The belt 1 conveys the paper P1 toward the conveyor 16 in the direction X. When the hole sensor 10 senses the holes of the belt 1, the rollers 3 and therefore the belt 1 stops moving. As shown in FIG. 3 specifically, two pairs of holes 1*a* are formed in the belt 1 such that when one pair of holes 1*a* are sensed by the hole sensor 10, the other pair of holes 1*a* are located at the position for sucking the paper P.

After the sensor 21 has sensed the mechanism 20, the servo motor 8 rotates in the reverse direction on the elapse of a preselected waiting time td necessary for the belt 1 to pick up one paper P. As a result, the mechanism 20 is returned to the position for sucking the paper P. At this instant, the mechanism 20 is moved at a speed as high as possible in order to suck the next paper P2 rapidly. This speed is also determined by experiments. When the sensor 22 again senses the mechanism 20 and turns on, the servo motor 8 is deenergized.

The procedure described above is repeated to pick up the consecutive papers P2, P3 and so forth at a high speed.

In the above embodiment, the base plate 7 is connected to the portion A at its upstream side so as to pivot about one fixed point at its downstream side. In addition, the sensors 22 and 21 are arranged around the upstream side of the base plate 7. Alternatively, the base plate 7 may be connected to a pivoting portion at its downstream side and caused to pivot thereby about a single fixed point located at the upstream side. In such a case, the sensors 22 and 21 will be arranged around the downstream side of the base plate 7.

Figure 5:
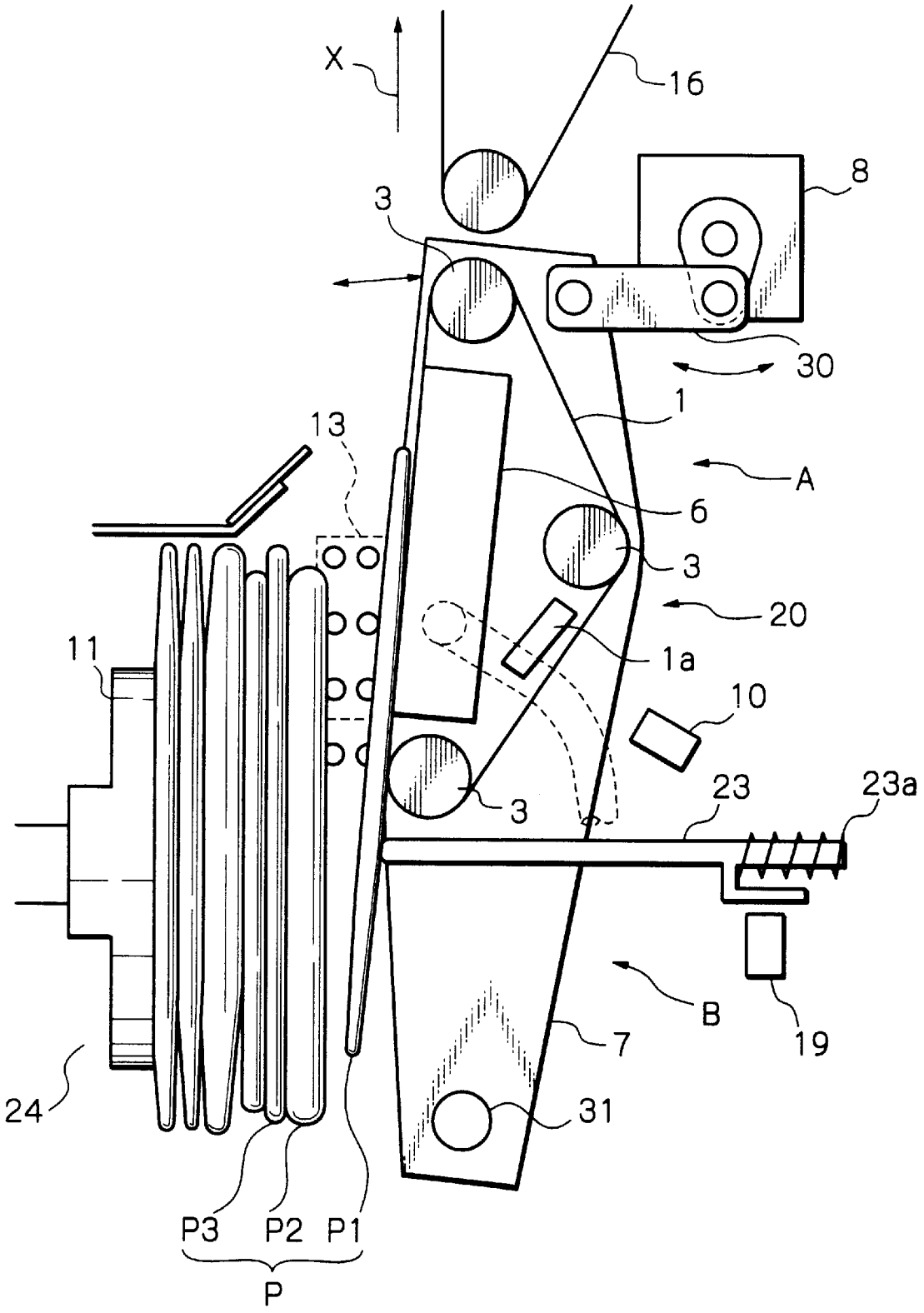
FIG. 5 is a view showing an alternative embodiment of the present invention.
Figure 6:
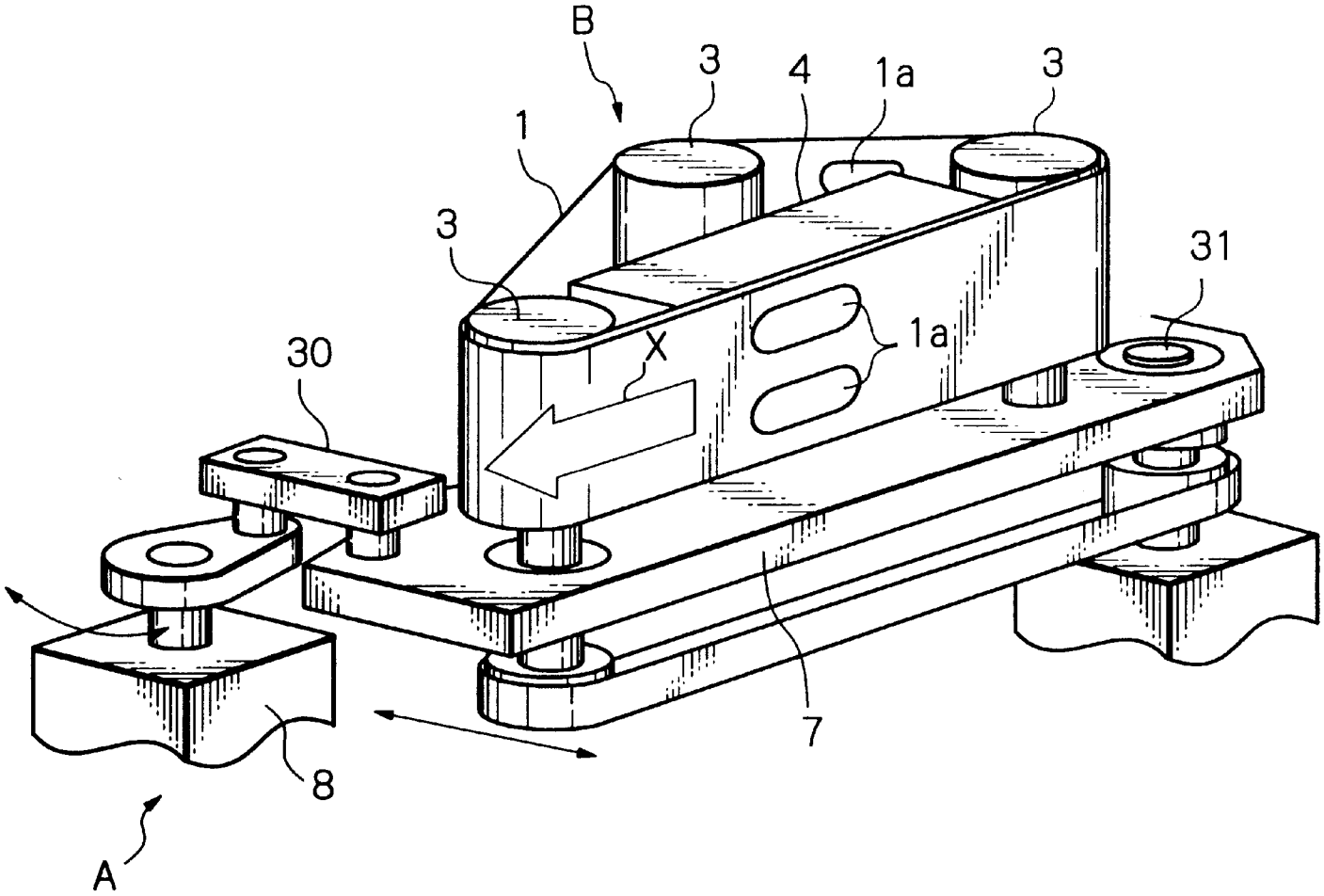
FIG. 6 is a view showing a specific configuration of a pick-up mechanism included in the alternative embodiment.

Referring to FIG. 5, an alternative embodiment of the present invention will be described. Briefly, in the alternative embodiment, the downstream side of the base plate 7 is connected to a pivoting portion, so that the plate 7 is angularly movable about a single point located at the upstream side. The sensors 22 and 21 are arranged around the downstream .side of the base plate 7, although not shown specifically. The base plate 7 and pivoting portion are connected to each other by a crank 30. In FIG. 5, structural elements identical with the structural elements shown in FIG. 2 are designated by like reference numerals and will not be described specifically in order to avoid redundancy.

As shown in FIG. 5, the mechanism 20 includes a pivoting portion, labeled A, for causing the mechanism 20 to pivot. A conveying portion, labeled B, causes the mechanism 20 to suck and convey the papers P. In the illustrative embodiment, the base p late 7 is connected to the pivoting portion A at its downstream side in the direction X and pivotable about a single point located at the upstream side, e.g., about a shaft 31. The conveying portion B is essentially identical in configuration with the conveying portion A of the previous embodiment. The pivoting portion A includes the crank 30 mentioned above, The crank 30 includes a plurality of arms and is connected at one end to the servo motor 8 and at the other end to the base p late 7. The servo motor 8 causes one of the arms of the crank 30 connected at one end to the motor 8 to move back and forth about the same end, so that the mechanism 20 is bodily movable over a preselected range about, e.g. the shaft 31.

Again, after the mechanism 20 has sucked one paper, it moves away from the other papers at a low speed. After the mechanism 20 has conveyed the paper, it moves toward the other papers at a high speed for sucking the next paper. As for the rest of the construction, this embodiment is substantially identical with the previous embodiment. The operation of the illustrative embodiment is analogous to the operation of the previous embodiment and will not be described specifically in order to avoid redundancy.

In summary, in accordance with the present invention, a method and an apparatus for picking up papers one by one include an air sending mechanism and a pick-up mechanism. The pick-up mechanism is angularly movable about a single point between a position for sucking the outermost paper and a position for conveying it. While the air sending mechanism sends air toward the bottom of a stack of papers positioned on a tray, the pick-up mechanism sucks the outermost paper and moves away from the other papers at a low speed. After the pick-up mechanism has conveyed the above paper, it moves toward the next paper for sucking it at a high speed. Air being sent from the air sending mechanism insures the separation of the consecutive papers.

Because the pick-up mechanism retaining the outermost sheet by suction moves slowly away from the other papers, the outermost paper is easily spaced from the other papers and therefore more surely separated from the other papers. This obviates a shearing force otherwise acting on and damaging, e.g., letters and magazines of delicate quality.

Various modifications will become possible for those skill ed in the art after receiving the teachings of the present disclosure without departing from the scope thereof.

What is claimed is:

1. A method of picking up a plurality of papers stacked in an upright position one by one, comprising:

angularly moving a pick-up mechanism about a pivot point, which is positioned either downstream with respect to a leading edge of an outermost one of said plurality of paper, or upstream with respect to a trailing edge of the outermost one of said plurality of papers;

applying a suction force, via a sucking surface of said pick-up mechanism to said outermost one of said plurality of papers; and conveying by said sucking surface said uppermost one of said plurality of papers, during and absent said application of said suction force, in a direction which is substantially parallel to said sucking surface, wherein a sucking surface of said pick-up mechanism and a surface of said outermost one of said plurality of papers are parallel to each other during said application of said suction force.

2. A method as claimed in claim 1, wherein said pick-up mechanism is angularly movable between a first position for sucking the outermost paper and a position for conveying said outermost paper.

3. A method as claimed in claim 2, wherein said pick-up mechanism having sucked the outermost paper moves away from the other papers at a low speed and moves, after conveying said outermost sheet, toward the next paper for sucking said next paper at a high speed.

4. A method as claimed in claim 3, wherein said pick-up mechanism is angularly movable about a downstream side thereof in a direction in which said pick-up mechanism sucked the outermost paper conveys said outermost paper.

5. A method as claimed in claim 4, wherein said pick-up mechanism is movable over a preselected angle.

6. A method as claimed in claim 1, wherein said pick-up mechanism having sucked the outermost paper moves away from the other papers at a low speed and moves, after conveying said outermost sheet, toward the next paper for sucking said next paper at a high speed.

7. A method as claimed in claim 1, wherein said pick-up mechanism is angularly movable about a downstream side thereof in a direction in which said pick-up mechanism sucked the outermost paper conveys said outermost paper.

8. A method as claimed in claim 1, wherein said pick-up mechanism is angularly movable about an upstream side thereof in a direction in which said pick-up mechanism sucked the outermost paper conveys said outermost paper.

9. A method as claimed in claim 11, wherein said pick-up mechanism is movable over a preselected angle.

10. A method of picking up a plurality of papers stacked in an upright position one by one, comprising:

angularly moving a pick-up mechanism about a pivot point, which is positioned either downstream with respect to a leading edge of an outermost one of said plurality of paper, or upstream with respect to a trailing edge of the outermost one of said plurality of papers;

applying a suction force, via a sucking surface of said pick-up mechanism, to said outermost one of said plurality of papers;

sending air toward bottoms of said papers; and conveying by said sucking surface said uppermost one of said plurality of papers, during and absent said application of said suction force, in a direction which is substantially parallel to said sucking surface, wherein a sucking surface of said pick-up mechanism and a surface of said outermost one of said plurality of papers are parallel to each other during said application of said suction force.

11. A method as claimed in claim 10, wherein said pick-up mechanism is angularly movable between a first position for sucking the outermost paper and a position for conveying said outermost paper.

12. A method as claimed in claim 11, wherein said pick-up mechanism having sucked the outermost paper moves away from the other papers at a low speed and moves, after conveying said outermost sheet toward the next paper for sucking said next paper at a high speed.

13. A method as claimed in claim 12, wherein said pick-up mechanism is angularly movable about a downstream side thereof in a direction in which said pick-up mechanism sucked the outermost paper conveys said outermost paper.

14. A method as claimed in claim 13, wherein said pick-up mechanism is movable over a preselected angle.

15. A method as claimed in claim 10, wherein said pick-up mechanism having sucked the outermost paper moves away from the other papers at a low speed and moves, after conveying sa id outermost sheer toward the next paper for sucking said next paper at a high speed.

16. A method as claimed in claim 10, wherein said pick-up mechanism is angularly movable about a downstream side thereof in a direction in which said pick-up mechanism sucked the outermost paper conveys said outermost paper.

17. A method as claimed in claim 10, wherein said pick-up mechanism is angularly movable about an upstream side thereof in a direction in which said pickup mechanism sucked the outermost paper conveys said outermost paper.

18. A method as claimed in claim 10, wherein said pick-up mechanism is movable over a preselected angle.

19. An apparatus for picking up a plurality of papers stacked in an upright position one by one, comprising:

a tray for stacking the papers; and a pick-up mechanism angularly movable about a pivot point, which is positioned either downstream with respect to a leading edge of an outermost one of said plurality of paper, or upstream with respect to a trailing edge of the outermost one of said plurality of papers, for applying a suction force to said outermost one of said plurality of papers, wherein a sucking surface of said pick-up mechanism and a surface of said outermost one of said plurality of papers are parallel to each other during said application of said suction force, and said sucking surface conveys said uppermost one of said plurality of papers, during and absent said application of said suction force, in a direction which substantially parallel to said sucking surface.

20. An apparatus as claimed in claim 19, wherein said pick-up mechanism comprises:

a pivoting portion for causing said pick-up mechanism to angularly move;

a conveying section for sucking and conveying the outermost paper; and a base plate on which said conveying portion is arranged, said base plate connected to said pivoting portion at an upstream side thereof in a direction of conveyance in which said conveying portion sucks and conveys the outermost paper, and pivotable about a single point located at a downstream side in said direction.

21. An apparatus as claimed in claim 20, wherein said conveying portion comprises:

a belt for conveying the outermost sheet while sucking said outermost sheet;

a plurality of rollers for moving said belt in the direction of conveyance; and a vacuum chamber facing a surface of said belt opposite to a surface which the outermost paper faces, for sucking said outermost paper with vacuum.

22. An apparatus as claimed in claim 20, wherein said pivoting portion comprises an arm connected at one end to a servo motor and at the other end to said base plate, said servo motor causing said arm to move back and forth about said one end to thereby cause said pick-up mechanism to move over a preselected angle about said single point.

23. An apparatus as claimed in claim 19, wherein said pick-up mechanism comprises:

a pivoting portion for causing said pick-up mechanism to angularly move;

a conveying section for sucking and conveying the outermost paper; and a base plate an which said conveying portion is arranged, said base plate connected to said pivoting portion at a downstream side thereof in a direction of conveyance in which said conveying portion sucks and conveys the outermost paper, and pivotable about a single point located at an upstream side in said direction.

24. An apparatus as claimed in claim 23, wherein said conveying portion comprises:

a belt for conveying the outermost sheet while sucking said outermost sheet;

a plurality of rollers for moving said belt in the direction of conveyance; and a vacuum chamber facing a surface of said belt opposite to a surface which the outermost paper faces, for sucking said outermost paper with vacuum.

25. An apparatus as claimed in claim 23, wherein said pivoting portion comprises an arm connected at one end to a servo motor and at the other end to said base plate, said servo motor causing said arm to move back and forth about said one end to thereby cause said pick-up mechanism to move over a preselected angle about said single point.

26. An apparatus as claimed in claim 23, wherein said pivoting portion comprises a crank including a plurality of arms and connected at one end to a servo motor and at the other end to said base plate said servo motor causing one of said plurality of arms having said one end to move back and forth about said one end to thereby cause said pick-up mechanism to move over a preselected angle about said single point.

27. An apparatus as claimed in claim 19, wherein said pick-up mechanism comprises:

a pivoting portion for causing said pick-up mechanism to angularly move;

a conveying section for sucking and conveying the outermost paper; and a base plate an which said conveying portion is arranged, said base plate connected to said pivoting portion at an upstream side thereof in a direction of conveyance in which said conveying portion sucks and conveys the outermost papers and pivotable about a single point located at a downstream side in said direction;

said conveying portion comprising:

a belt for conveying the outermost sheet while sucking said outermost sheet;

a plurality of rollers for moving said belt in the direction of conveyance; and a vacuum chamber facing a surface of said belt opposite to a surface which the outermost paper faces, for sucking said outermost paper with vacuum;

said pivoting portion comprising an arm connected at one end to a servo motor and at the other end to said base plates said servo motor causing said arm to move back and forth about said one end to thereby cause said pick-up mechanism to move over a preselected angle about said single point.

28. An apparatus as claimed in claim 19, wherein said pick-up mechanism comprises:

a pivoting portion for causing said pick-up mechanism to angularly move:

a conveying section for sucking and conveying the outermost paper; and a base plate on which said conveying portion is arranged, said base plate connected to said pivoting portion at a downstream side thereof in a direction of conveyance in which said conveying portion sucks and conveys the outermost paper and pivotable about a single point located at an upstream side in said direction;

said conveying portion comprising:

a belt for conveying the outermost sheet while sucking said outermost sheet;

a plurality of rollers for moving said belt in the direction of conveyance: and a vacuum chamber facing a surface of said belt opposite to a surface which the outermost paper faces, for sucking said outermost paper with vacuum;

said pivoting portion comprising an arm connected at one end to a servo motor and at the other end to said base plate, said servo motor causing said arm to move back and forth about said one end to thereby cause said pick-up mechanism to move over a preselected angle about said single point.

29. An apparatus as claimed in claim 19, wherein said pick-up mechanism comprises:

a pivoting portion for causing said pick-up mechanism to angularly move;

a conveying section for sucking and conveying the outermost paper; and a base plate on which said conveying portion is arranged, said base plate connected to said pivoting portion at a downstream side thereof in a direction of conveyance in which said conveying portion sucks and conveys the outermost paper, and pivotable about a single point located at an upstream side in said direction:

said conveying portion comprising:

a belt for conveying the outermost sheet while sucking said outermost sheet;

a plurality of rollers for moving said belt in the direction of conveyance; and a vacuum chamber facing a surface of said belt opposite to a surface which the outermost paper faces, for sucking said outermost paper with vacuum;

said pivoting portion comprising a crank including a plurality of arms and connected at one end to a servo motor and at the other end to said base plated said servo motor causing one of said plurality of arms having said one end to move back and forth about said one end to thereby cause said pick-up mechanism to move over a preselected angle about said single point.

30. An apparatus as claimed in claim 19, wherein said pick-up mechanism is angularly movable between a first position for sucking the outermost paper and a position for conveying said outermost paper.

31. An apparatus as claimed in claim 19, wherein said pick-up mechanism having sucked the outermost paper moves away from the other papers at a low speed and moves, after conveying said outermost sheets toward the next paper for sucking said next paper at a high speed.

32. An apparatus for picking up a plurality of papers stacked in an upright position one by one, comprising:

a tray for stacking the papers; and a pick-up mechanism angularly movable for sucking an outermost one of said plurality of papers and picking up said outermost one, wherein said pick-up mechanism comprises:

a pivoting portion for causing said pick-up mechanism to angularly move;

a conveying section for sucking and conveying the outermost paper; and a base plate on which said conveying portion is arranged, said base plate connected to said pivoting portion at an upstream side thereof in a direction of conveyance in which said conveying portion sucks and conveys the outermost paper, and pivotable about a single point located at a downstream side in said direction, and wherein said pivoting portion comprises a crank including at least one arm and connected at one end to a servo motor and at the other end to said base plate, said servo motor causing said at least one arm having said one end to move back and forth about said one end to thereby cause said pick-up mechanisms to move over a preselected angle about said single point.

33. An apparatus for picking up a plurality of papers stacked in an upright position one by one, comprising:

a tray for stacking the papers; and a pick-up mechanism angularly movable for sucking an outermost one of said plurality of papers and picking up said outermost one, wherein said pick-up mechanism comprises:

a pivoting portion for causing said pick-up mechanism to angularly move;

a conveying section for sucking and conveying the outermost paper; and a base plate on which said conveying portion is arranged, said base plate connected to said pivoting portion at an upstream side thereof in a direction of conveyance in which said conveying portion sucks and conveys the outermost paper, and pivotable about a single point located at a downstream side in said direction; said conveying portion comprising:

a belt for conveying the outermost sheet while sucking said outermost sheet;

a plurality of rollers for moving said belt in the direction of conveyance; and a vacuum chamber facing a surface of said belt opposite to a surface which the outermost paper faces, for sucking said outermost paper with vacuum;

said pivoting portion comprising a crank including at least one arm and connected at one end to a servo motor and at the other end to said base plate, said servo motor causing said at least one arm having said one end to move back and forth about said one end to thereby cause said pick-up mechanism to move over a preselected angle about said single point.

34. An apparatus for picking up a plurality of papers stacked in an upright position one by one, comprising:

a tray for stacking the papers;

a mechanism for sending air toward bottoms of the papers stacked on said tray; and a pick-up mechanism angularly movable about a pivot point, which is positioned either downstream with respect to a leading edge of an outermost one of said plurality of paper, or upstream with respect to a trailing edge of the outermost one of said plurality of papers, for applying a suction force to said outermost one of said plurality of papers, wherein a sucking surface of said pick-up mechanism and a surface of said outermost one of said plurality of papers are parallel to each other during said application of said suction force, and said sucking surface conveys said uppermost one of said plurality of papers, during and absent said application of said suction force, in a direction which is substantially parallel to said sucking surface.

35. An apparatus as claimed in claim 34, wherein said pick-up mechanism comprises:

a pivoting portion for causing said pick-up mechanism to angularly move;

a conveying section for sucking and conveying the outermost paper; and a base plate on which said conveying portion is arranged, said base plate connected to said pivoting portion at an upstream side thereof in a direction of conveyance in which said conveying portion sucks and conveys the outermost papers and pivotable about a single point located at a downstream side in said direction.

36. An apparatus as claimed in claim 35, wherein said conveying portion comprises:

a belt for conveying the outermost sheet while sucking said outermost sheet;

a plurality of rollers for moving said belt in the direction of conveyance; and a vacuum chamber facing a surface of said belt opposite to a surface which the outermost paper faces, for sucking said outermost paper with vacuum.

37. An apparatus as claimed in claim 35, wherein said pivoting portion comprises an arm connected at one end to a servo motor and at the other end to said base plates said servo motor causing said arm to move back and forth about said one end to thereby cause said pick-up mechanism to move over a preselected angle about said single point.

38. An apparatus as claimed in claim 34, wherein said pick-up mechanism comprises:

a pivoting portion for causing said pick-up mechanism to angularly move;

a conveying section for sucking and conveying the outermost paper; and a base plate on which said conveying portion is arranged, said base plate connected to said pivoting portion at a downstream side thereof in a direction of conveyance in which said conveying portion sucks and conveys the outermost paper, and pivotable about a single point located at an upstream side in said direction.

39. An apparatus as claimed in claim 38, wherein said conveying portion comprises:

a belt for conveying the outermost sheet while sucking said outermost sheet;

a plurality of rollers for moving said belt in the direction of conveyance; and a vacuum chamber facing a surface of said belt opposite to a surface which the outermost paper faces, for sucking said outermost paper with vacuum.

40. An apparatus as claimed in claim 38, wherein said pivoting portion comprises an arm connected at one end to a servo motor and at the other end to said base plate, said servo motor causing said arm to move back and forth about said one end to thereby cause said pick-up mechanism to move over a preselected angle about said single point.

41. An apparatus as claimed in claim 38, wherein said pivoting portion comprises a crank including a plurality of arms and connected at one end to a servo motor and at the other end to said base plate, said servo motor causing one of said plurality of arms having said one end to move back and forth about said one end to thereby cause said pick-up mechanism to move over a preselected angle about said single point.

42. An apparatus as claimed in claim 34, wherein said pick-up mechanism comprises:

a pivoting portion for causing said pick-up mechanism to angularly move;

a conveying section for sucking and conveying the outermost paper; and a base plate on which said conveying portion is arranged, said base plate connected to said pivoting portion at an upstream side thereof in a direction of conveyance in which said conveying portion sucks and conveys the outermost paper, and pivotable about a single point located at a downstream side in said direction;

said conveying portion comprising:

a belt for conveying the outermost sheet while sucking said outermost sheet;

a plurality of rollers for moving said belt in the direction of conveyance; and a vacuum chamber facing a surface of said belt opposite to a surface which the outermost paper faces, for sucking said outermost paper with vacuum;

said pivoting portion comprising an arm connected at one end to a servo motor and at the other end to said base plates said servo motor causing said arm to move back and forth about said one end to thereby cause said pick-up mechanism to move over a preselected angle about said single point.

43. An apparatus as claimed in claim 34, wherein said pick-up mechanism comprises:

a pivoting portion for causing said pick-up mechanism to angularly move;

a conveying section for sucking and conveying the outermost paper; and a base plate on which said conveying portion is arranged, said base plate connected to said pivoting portion at a downstream side thereof in a direction of conveyance in which said conveying portion sucks and conveys the outermost paper, and pivotable about a single point located at an upstream reside in said direction;

said conveying portion comprising:

a belt for conveying the outermost sheet while sucking said outermost sheet;

a plurality of rollers for moving said belt in the direction of conveyance; end a vacuum chamber facing a surface of said belt opposite to a surface which the outermost paper faces, for sucking said outermost paper with vacuum;

said pivoting portion comprising an arm connected at one end to a servo motor and at the other end to said base plate, said servo motor causing said arm to move back and forth about said one end to thereby cause said pick-up mechanism to move over a preselected angle about said single point.

44. An apparatus as claimed in claim 34, wherein said pick-up mechanism comprises:

a pivoting portion for causing said pick-up mechanism to angularly move;

a conveying section for sucking and conveying the outermost paper; and a base plate on which said conveying portion is arranged, said base plate connected to said pivoting portion at a downstream side thereof in a direction of conveyance in which said conveying portion sucks and conveys the outermost paper, and pivotable about a single point located at an upstream side in said direction;

said conveying portion comprising:

a belt for conveying the outermost sheet while sucking said outermost sheet, a plurality of rollers for moving said belt in the direction of conveyance; and a vacuum chamber facing a surface of said belt opposite to a surface which the outermost paper face, for sucking said outermost paper with vacuum;

said pivoting portion comprising a crank including a plurality of arms and connected at one end to a servo motor and at the other end to said base plate, said servo motor causing one of said plurality of arms having said one end to move beck and forth about said one end to thereby cause said pick-up mechanism to move over a preselected angle about said single point.

45. An apparatus as claimed in claim 34, wherein said pickup mechanism is angularly movable between a first position for sucking the outermost paper and a position for conveying said outermost paper.

46. An apparatus as claimed in claim 34, wherein said pickup mechanism having sucked the outermost paper moves away from the other papers at a low speed and moves, after conveying said outermost sheet, toward the next paper for sucking said next paper at a high speed.

47. An apparatus for picking up a plurality of papers stacked in an upright position one by one, comprising:

a tray for stacking the papers;

a mechanism for sending air toward bottoms of the papers stacked on said tray; and a pick-up mechanism angularly movable for sucking an outermost one of said plurality of papers and picking up said outermost one, wherein said pick-up mechanism comprises:

a pivoting portion for causing said pick-up mechanism to angularly move;

a conveying section for sucking and conveying the outermost paper; and a base plate on which said conveying portion is arranged, said base plate connected to said pivoting portion at an upstream side thereof in a direction of conveyance in which said conveying portion sucks and conveys the outermost paper, and pivotable about a single point located at a downstream side in said direction, and wherein said pivoting portion comprises a crank including at least one arm and connected at one end to a servo motor and at the other end to said base plate, said servo motor causing said at least one arm having said one end to move back and forth about said one end to thereby cause said pick-up mechanism to move over a preselected angle about said single point.

48. An apparatus for picking up a plurality of papers stacked in an upright position one by one, comprising:

a tray for stacking the papers;

a mechanism for sending air toward bottoms of the papers stacked on said tray; and a pick-up mechanism angularly movable for sucking an outermost one of said plurality of papers and picking up said outermost one, wherein said pick-up mechanism comprises:

a pivoting portion for causing said pick-up mechanism to angularly move;

a conveying section for sucking and conveying the outermost paper; and a base plate on which said conveying portion is arranged, said base plate connected to said pivoting portion at an upstream side thereof in a direction of conveyance in which said conveying portion sucks and conveys the outermost paper, and pivotable about a single point located at a downstream side in said direction; said conveying portion comprising:

a belt for conveying the outermost sheet while sucking said outermost sheet;

a plurality of rollers for moving said belt in the direction of conveyance; and a vacuum chamber facing a surface of said belt opposite to a surface which the outermost paper faces, for sucking said outermost paper with vacuum;

said pivoting portion comprising a crank including at least one arm and connected at one end to a servo motor and at the other end to said base plate, said servo motor causing said at least one arm having said one end to move back and forth about said one end to thereby cause said pick-up mechanism to move over a preselected angle about said single point.

* * * * *